United States Patent [19]

Clark

[11] 4,300,322

[45] Nov. 17, 1981

[54] INSULATION

[76] Inventor: William H. Clark, 4284 E. State St., Sharon, Pa. 16146

[21] Appl. No.: 134,874

[22] Filed: Mar. 28, 1980

[51] Int. Cl.[3] ..... E04B 1/62

[52] U.S. Cl. ..... 52/406; 52/809; 52/DIG. 9; 428/121

[58] Field of Search ..... 52/406, 407, DIG. 9, 52/743, 796, 809; 428/121

[56] References Cited

U.S. PATENT DOCUMENTS

| | | | |
|---|---|---|---|
| 1,939,306 | 12/1933 | Leslie | 52/DIG. 9 |
| 1,957,822 | 5/1934 | Denning | 52/406 |
| 1,963,609 | 6/1934 | Balduf et al. | 52/796 |
| 2,123,869 | 7/1938 | Walker | 52/406 X |
| 2,631,644 | 3/1953 | Cole | 428/121 |

FOREIGN PATENT DOCUMENTS

| | | | |
|---|---|---|---|
| 6506245 | 11/1966 | Netherlands | 52/406 |

*Primary Examiner*—J. Karl Bell

*Attorney, Agent, or Firm*—Webster B. Harpman

[57] ABSTRACT

An insulation material comprised of multiple layers of treated newspaper in a compartmentalized air impervious resin container or use as side wall or ceiling insulation bats in homes or like structures.

5 Claims, 4 Drawing Figures

FIG. 1
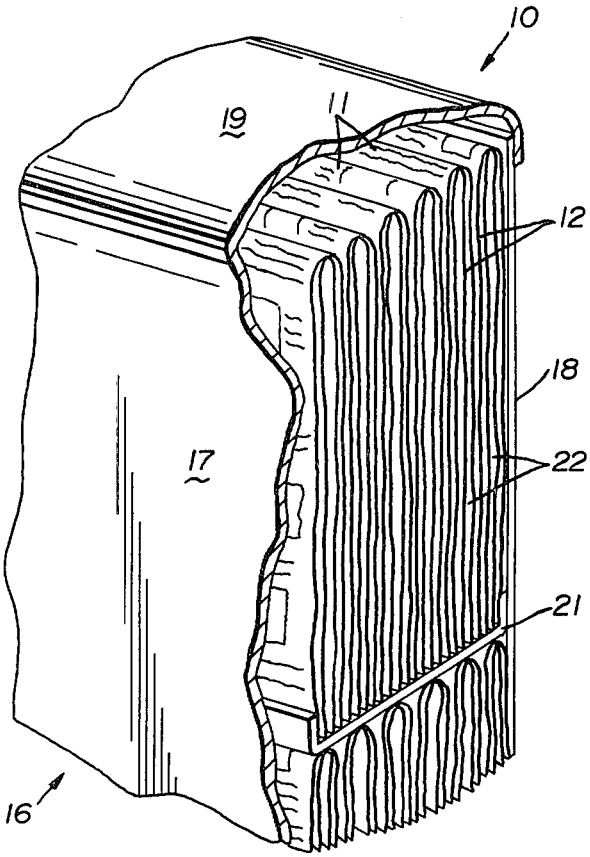
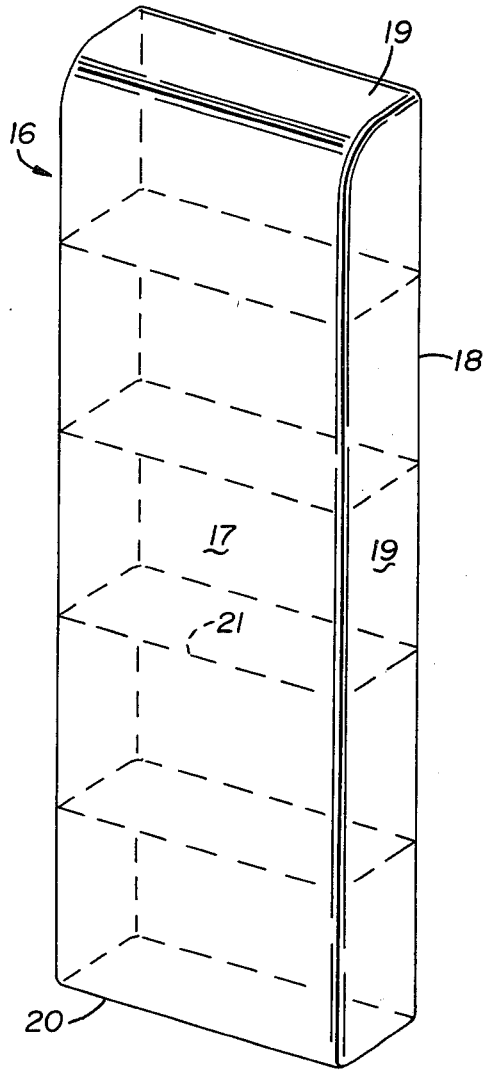
FIG. 2
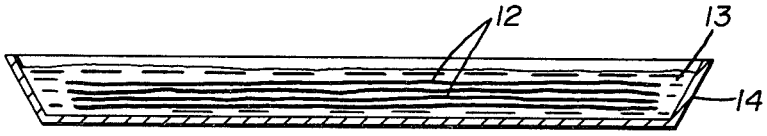
FIG. 3
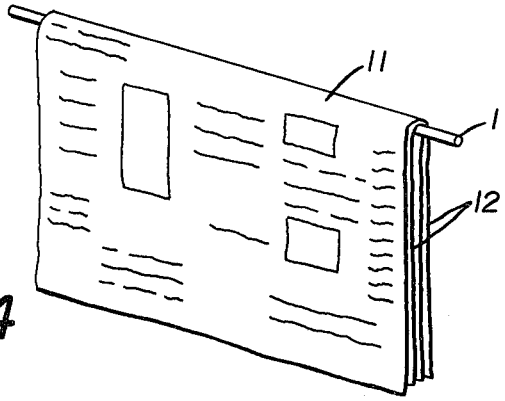
FIG. 4

INSULATION

BACKGROUND OF THE INVENTION (1) Field of the Invention:

This invention relates to insulation material of the type formed of paper or the like for use as an insulation in building structures.

(2) Description of the Prior Act:

Prior structures of this type have used a number of paper construction configurations. See for example U.S. Pat. Nos. 1,963,609 and 2,045,733.

In U.S. Pat. No. 2,045,733 an insulation structure is shown wherein a number of corrugated sheets are adhesively joined to one another with additional sheets there between.

Applicant's invention utilizes multiple sheets of folded treated newspaper within an air tight enclosure of aluminized synthetic resin or the like.

U.S. Pat. No. 1,963,609 discloses a building insulation having mats of laminated paper formed into a rigid shape.

In the present invention, several sheets of the treated newspaper are loosely folded and positioned in compartments in an air impervious bag like structure preferably made of synthetic resin. The newspaper sheets crinkle when they are treated and dried so that additional air spaces are formed between the several sheets and the thickness of the assembly increased.

SUMMARY OF THE INVENTION

An insulation material formed of multiple layers of crinkled newspaper sheets treated with a solution of fire preventing and insect resistant material are arranged within compartments of an air impervious aluminized synthetic resin container, the newspaper layers are formed of folded sheets arranged to be spaced with respect to one another.

DESCRIPTION OF THE DRAWINGS

FIG. 1 is a perspective view of the insulation with parts cut away and parts in cross section.

FIG. 2 is a perspective view of the insulation bat.

FIG. 3 is a diagramatic representation of a solution filled tray showing the treating of the newspaper sheets, and FIG. 4 is a perspective view of the treated newspaper sheets in drying position.

DESCRIPTION OF THE PREFERRED EMBODIMENT

In FIG. 1 of the drawings a portion of the insulation material 10 is shown comprising a number of folded rectangular body members 11 adjacent one another. Each of said body members 11 is made up of multiple sheets of newspaper 12 treated with a solution 13 that acts as a fire retardant and preservative such as a water glass. In FIGS. 3 and 4 of the drawings, sheets of newspaper 12 are shown being soaked in a pan 14 filled with a water glass solution 13. The sheets are then folded over a rod 15 as seen in FIG. 4 and allowed to dry in the folded shape. The newspaper crinkles as it dries and is relatively stiff. Referring now to FIGS. 1 and 2 of the drawings and elongated thin wall container 16 has oppositely disposed space parallel front and back walls 17 and 18 with intricately extending side walls 19 and ends 20. A number of partitions 21 are positioned in vertical space relation to one another in the container 16 and secured therein between said front and back walls 17 and 18 by heat sealing and forming a series of space compartments. The treated folded newspaper sheets 12 are inserted in said compartments in layers providing a plurality of air spaces 22 therebetween the treated and dried newspaper sheets 12.

It will be seen that the folded crinkled dried newspaper sheets thus fill the container to form a bat of insulation material with length and width like that of the usual insulation bat known in the art. Partitions 21 run transversely to keep the container in a desired bat shape and to prevent the folded newspaper sheets from settling, and contribute to the flexibility of the insulation that is required in installing same. The water glass 12 used is a solution of sodium silicate or potassium silicate such as 40% $Na_2Si_3O_7$ and 60% $H_2O$. The container 16 is preferably made of synthetic resin film material with a bonded aluminized surface which is commercially known as Astrolon 1 manufactured by King Seeley of Winchester, Mass. 01890 and is described as consisting of one layer of 0.0005 aluminized clear polyethylene and one layer of 0.00125 of aluminized colored polyethylene bonded and embossed together.

It will thus be seen that the insulation material hereinbefore described utilizes multiple layers of treated crinkled and folded newspaper loosely positioned together and having a number of air spaces therebetween. The several newspaper sheet layers being spaced with respect to one another by the shaping of the same that occurs when they are folded and dried over the rods as herein disclosed. The folded crinkled dried sheets being sealed in the compartments of the container.

Thus it will be seen that a new and useful insulation material has been illustrated and described and it will be apparent to those skilled in the art that various modifications and changes may be made herein without departing from the spirit of the invention therefore I claim:

1. Insulation material consisting of a container formed of flexible material and of an insulating batt configuration, a plurality of layers of newspaper sheets positioned in said container, said newspaper sheets treated with a liquid fire resistant preservative, such as a solution of water glass, namely 40% $Na_2Si_3O_7$ and 60% $H_2O$ and dried before they are positioned in said container so as to have a folded stiffened characteristic, said plurality of layers of newspaper sheets loosely filling the container and wherein a plurality of air spaces are formed between the sheets of the newspaper and the layers thereof.

2. The insulation material of claim 1 wherein said container is made of an air impervious synthetic resin sheet material having an aluminized surface.

3. The insulation material of claim 1 wherein partitions are positioned in said container in spaced relation to each other a distance equal to that of the folded treated newspaper sheets so as to prevent settling of said newspaper sheets in said container.

4. The insulation material of claim 1 and wherein said newspaper sheets are crinkled by wetting the same with said fire resistant preservative and drying thereafter so as to add the number of air spaces between said newspaper sheets.

5. The insulation material of claim 3 and wherein said newspaper sheets are loosely positioned in said container in groups defined by said partitions.

* * * * *